United States Patent [19]

Park

[11] Patent Number: 4,769,864

[45] Date of Patent: Sep. 13, 1988

[54] THERAPEUTIC BED

[76] Inventor: Ki D. Park, 920 H St., NE., Washington, D.C. 20002

[21] Appl. No.: 120,140

[22] Filed: Nov. 13, 1987

[51] Int. Cl.[4] ..... A47C 19/00

[52] U.S. Cl. ..... 5/190; 5/200 R

[58] Field of Search ..... 5/131, 132, 186 R, 189, 5/190, 194, 200 R, 207, 212, 227

[56] References Cited

U.S. PATENT DOCUMENTS

| | | | |
|---|---|---|---|
| 1,813,019 | 7/1937 | Brown | 5/194 X |
| 2,156,664 | 5/1939 | Litle, Jr. | 5/190 |
| 3,129,441 | 4/1964 | Zastera et al. | 5/190 X |
| 3,914,811 | 10/1975 | Francis | 5/457 |
| 4,360,736 | 11/1982 | Weissenfluh | 5/457 |
| 4,435,864 | 3/1984 | Callaway | 5/457 |
| 4,551,874 | 11/1985 | Matsumura et al. | 5/457 |

FOREIGN PATENT DOCUMENTS

| | | | |
|---|---|---|---|
| 1229152 | 9/1960 | France | 5/190 |
| 7708597 | 2/1979 | Netherlands | 5/190 |
| 21821 | 11/1904 | United Kingdom | 5/194 |
| 444455 | 3/1936 | United Kingdom | 5/190 |

*Primary Examiner*—Michael F. Trettel

*Attorney, Agent, or Firm*—Birch, Stewart, Kolasch & Birch

[57] ABSTRACT

A therapeutic bed comprises a plurality of elongated tubular wires connected to a pair of bed frames for forming a bed floor to massage or treat various regions of the human body lying prone thereon.

4 Claims, 3 Drawing Sheets

THERAPEUTIC BED

BACKGROUND OF THE INVENTION

1. Field of the Invention

The present invention relates to a therapeutic bed and more particularly, to a rubber wire bed which is structured with a plurality of individual elongated rubber wires placed in a serpentine configuration on a bed frame for manipulating the tissues of the human body reclining thereon. The therapeutic bed is utilized by the human being particularly, the pneumatic or lumbago patient, for massaging any desired regions of the human body lying prone thereon.

2. Description of the Prior Art

Many types of therapeutic beds are well known in the art which use air bags or water containers. However, since these air bags or water containers bulge at their central portion, the body lying thereon become unstable. Furthermore, because air and/or water is displaced when pressure is applied thereto, the pressure force from these bags or containers is not concentrated at the desired regions of the body such as joints, bones, or muscles of human body which require therapeutic assistance.

SUMMARY OF THE INVENTION

It is therefor an object of the present invention to provide a therapeutic bed for massaging desired regions of the human body.

Another object of the present invention is to provide a therapeutic bed which is structured with a plurality of individual elongated wires which are arranged parallel to each other and disposed within bed frames for directly contacting various portions of the human body reclining thereon.

Other objects and further scope of applicability of the present invention will become apparent from the detailed description given hereinafter. It should be understood, however, that the detailed description and specific examples, while indicating preferred embodiments of the invention, are given by way of illustration only, since various changes and modifications within the spirit and scope of the invention will become apparent to those skilled in the art from this detailed description.

Briefly, the present invention relates to a therapeutic bed comprising a plurality of substantially parallel rubber wires placed on a bed frame for massaging and treating various portions of the human body.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

DETAILED DESCRIPTION OF THE INVENTION

Figure 1:
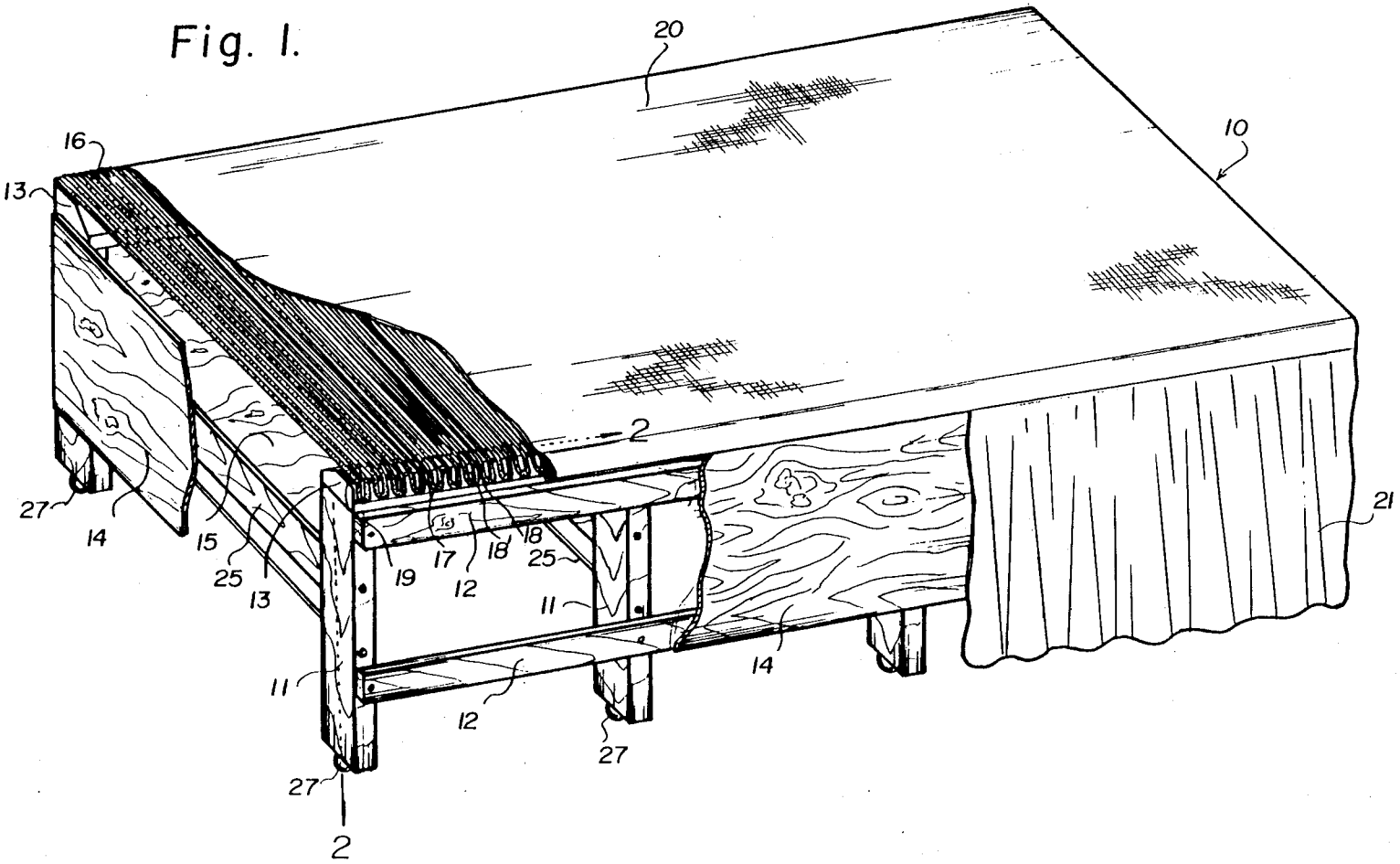
FIG. 1 is a perspective view of the therapeutic bed of the present invention.

Referring now in detail to the drawings for the purpose of illustrating the present invention, the therapeutic bed 10 as shown in FIG. 1 comprises base members 11, a pair of longitudinal and transverse frames 12 and 25 connected to the base members 11, a plurality of individual elongated members 16 provided with a thin bed pad 20, and a pair of tapered connecting members 13 attached to the top of the base members at the four corners for connecting the tensible tubular members 16 thereto.

Figure 3:
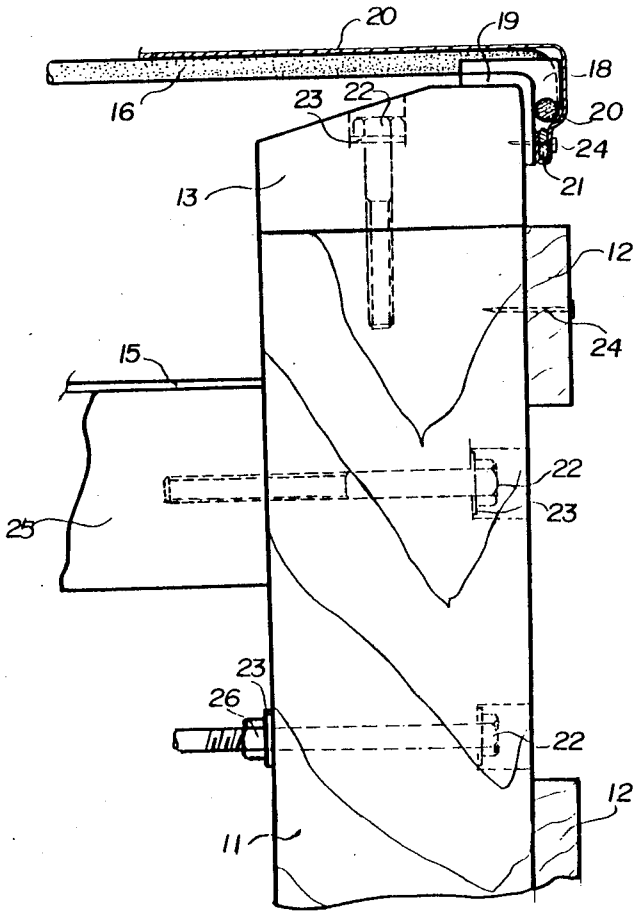
FIG. 3 is a partial side view of the therapeutic bed of the present invention.

The longitudinal and transverse frame 12 and 25 are attached to and supported with the base members 11 through nails 24 (FIG. 3). A plurality of side panels 14 connects with the longitudinal and transverse frames 12 and 25. Each base member 11 has a roller 27 disposed on the bottom thereof for readily moving the bed 10. The therapeutic bed 10 includes a bedding 21 along the side walls thereof.

Figure 2:
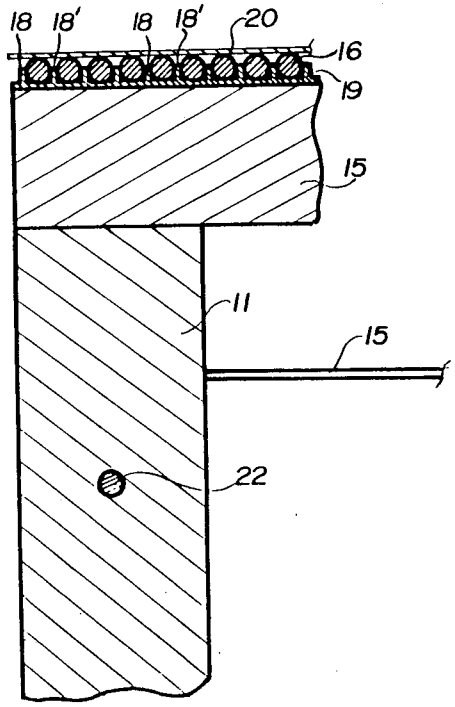
FIG. 2 is a cross-sectional view of FIG. 1, taken along line 2—2.
Figure 4:
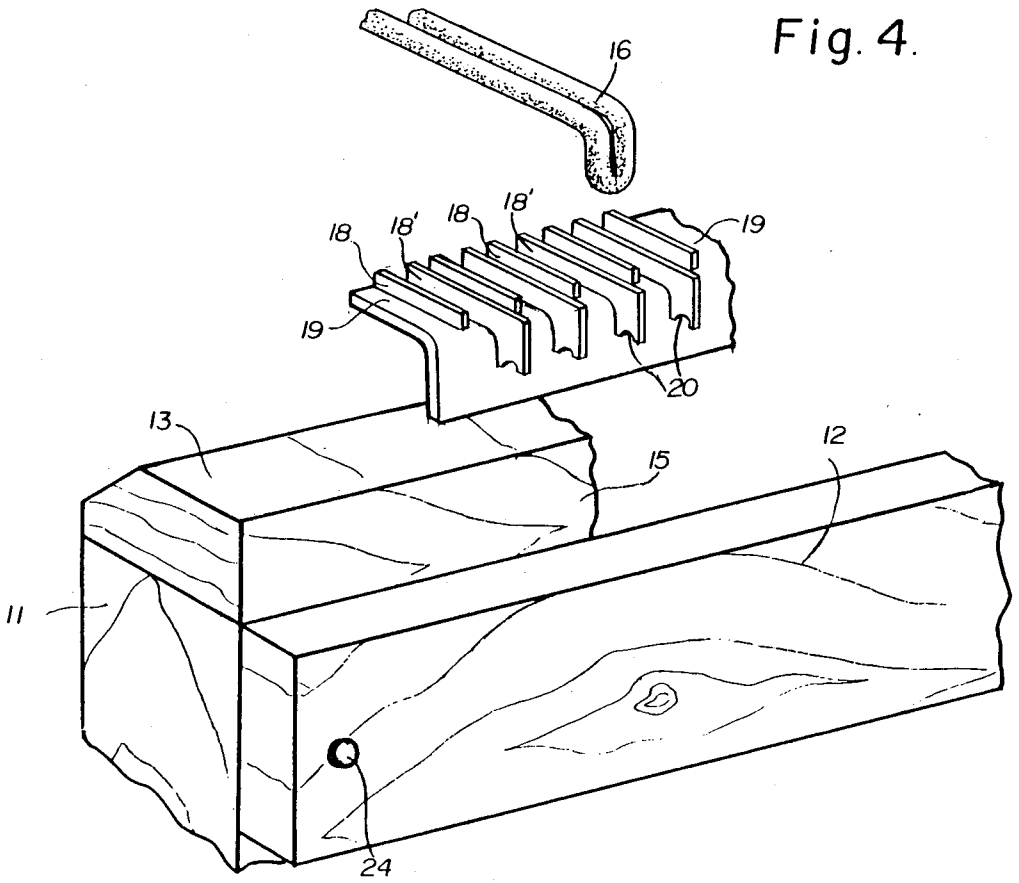
FIG. 4 is an exploded view showing the basic components of the bed according to the present invention.

As shown in FIGS. 2, 3 and 4, the pair of connecting members 13 are attached to the base members through bolts 22 and washers 23. A pair of L-shaped brackets 19 are attached to the each pair of connecting members 13 and are further provided with a plurality of separating partitions 18 and 18' which alternately extend around the edge of the brackets 19 and a plurality of slots 20 disposed at the ends of the alternate partitions 18' for holding the tensible wires 16 in the slots 20 and spaces disposed between partitions 18 and 18' (FIG. 4). Thus, the parallel wires 16 connected between the side slots 20 on opposite sides of the longitudinal frame form a tensible bed floor for directly contacting various regions of the human body. At this time, since the tensible wires 16 extend across the bed, the wires 16 can readily massage joint portions, muscles, and bones of the human body. Furthermore, since the tensible wires 16 can be extended, the pressure power can be varied according to need by tightening the wires in order to concentrate the desired pressure to the joint portions of human body for treating the lumbago or pneumatic diseases or the like. A floor panel 15 is disposed under the wires 16. The tensible wires 16 are made of a flexible, stretchable material such as a natural or synthetic rubber, a plastic material, a thermoplastic material, or the like. The wire 16 should have the property of stretchability in order to vary the resistance to the weight of the human body. Although the wires 16 are typically of solid construction they can also include cord or metal wires coated with a rubber or plastic material.

The bed pad 20 is stopped at a stopper 21 through a nail 21.

The therapeutic bed can achieve the function of a conventional mattress. Furthermore, the air can easily communicate through the spaces disposed between the wires-bed floor so that it can help to give the fresh air to supply the human body.

The invention being thus described, it will be obvious that the same may be varied in many ways. Such variations are not to be regarded as a departure from the spirit and scope of the invention, and all such modifications as would be obvious to one skilled in the art are intended to be included in the scope of the following claims.

What is claimed is:

1. A therapeutic bed for the human body comprising: base members, a pair of longitudinal frames connected to said base member, transverse bed frames connected to said base member and said base members, longitudinal frames and transverse frames defining a bed support member, connecting members attached to the top of the base members of said bed support member, said connecting member having a tapered configuration at the top surface thereof for permitting flexibility in the bedfloor, a pair of brackets attached to said connecting members and extending longitudinally along said longitudinal bed frames, said brackets having L-shaped configuration and containing a plurality of separating partitions which alternately extend around the edge of said brackets for defining spaces formed between said portions and a plurality of slots disposed at the ends of said alternate partitions, and a flexible and extendable wire passed through said spaces and slots on alternate sides of the bed in a serpentine configuration whereby said wire defines a bedfloor for treating and massaging regions of the human body disposed thereon.

2. The therapeutic bed of claim 1 wherein the flexible and extendable tubular wire is made of flexible material.

3. The therapeutic bed of claim 2 wherein the flexible material is made of a plastic.

4. The therapeutic bed of claim 3 wherein the flexible material is made of a rubber material.

* * * * *